US009129554B2

(12) United States Patent
Kim et al.

(10) Patent No.: US 9,129,554 B2
(45) Date of Patent: Sep. 8, 2015

(54) ORGANIC LIGHT-EMITTING DISPLAY DEVICE WITH DATA DRIVER OPERABLE WITH SIGNAL LINE CARRYING BOTH DATA SIGNAL AND SENSING SIGNAL

(71) Applicant: LG Display Co., Ltd., Seoul (KR)

(72) Inventors: Seung Tae Kim, Goyang-si (KR); Jin Hyoung Kim, Goyang-si (KR); Jong Sik Shim, Seoul (KR); Won Kyu Ha, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 214 days.

(21) Appl. No.: 13/710,061

(22) Filed: Dec. 10, 2012

(65) Prior Publication Data

US 2013/0147694 A1 Jun. 13, 2013

(30) Foreign Application Priority Data

Dec. 12, 2011 (KR) ..... 10-2011-0133272

(51) Int. Cl.

*G09G 3/00* (2006.01)
*G09G 3/32* (2006.01)
*G09G 3/36* (2006.01)

(52) U.S. Cl.

CPC ..... *G09G 3/32* (2013.01); *G09G 3/3233* (2013.01); *G09G 3/3659* (2013.01); *G09G 3/3275* (2013.01); *G09G 2320/029* (2013.01); *G09G 2320/0233* (2013.01)

(58) Field of Classification Search

CPC ..... G09G 3/3275; G09G 2300/43
USPC ..... 345/82
See application file for complete search history.

(56) References Cited

U.S. PATENT DOCUMENTS

2011/0084955 A1* 4/2011 Kim ..... 345/212
2011/0084958 A1 4/2011 Choi et al.

FOREIGN PATENT DOCUMENTS

CN 102044214 A 5/2011
KR 10-2011-0108033 A 10/2011
TW 200701172 A 1/2007
TW 201248590 A 12/2012

OTHER PUBLICATIONS

Taiwan Intellectual Property Office, First Office Action, Taiwanese Patent Application No. 101146195, Nov. 7, 2014, sixteen pages.

* cited by examiner

*Primary Examiner* — Amare Mengistu
*Assistant Examiner* — Joseph G Rodriguez
(74) *Attorney, Agent, or Firm* — Fenwick & West LLP

(57) ABSTRACT

An organic light emitting display device having a data line that is used for sending data voltage signals to pixels from a data driver as well as send sensor signals for detecting threshold voltage levels of driving transistors in the pixels at different times. By using the same data line to transmit the data voltage signals and the sensor signals, the number of signal lines in the organic light emitting display can be reduced. The data driver also includes switches for selectively coupling the data line to a driver unit or an analog to digital converter (ADC) unit.

19 Claims, 11 Drawing Sheets

ORGANIC LIGHT-EMITTING DISPLAY DEVICE WITH DATA DRIVER OPERABLE WITH SIGNAL LINE CARRYING BOTH DATA SIGNAL AND SENSING SIGNAL

CROSS-REFERENCE TO RELATED APPLICATIONS

The present application claims priority under 35 U.S.C. §119(a) to Korean Patent Application No. 10-2011-0133272 filed on Dec. 12, 2011, which is hereby incorporated by reference in its entirety.

BACKGROUND

1. Field of the Disclosure

The present application relates to an organic light-emitting display (OLED) device.

2. Description of the Related Art

Display devices for displaying information are being widely developed. The display devices include liquid crystal display devices, organic light-emitting display devices, electrophoresis display devices, field emission display devices, and plasma display device.

Among these display devices, organic light-emitting display devices have the features of lower power consumption, wider viewing angle, lighter weight and higher brightness compared to liquid crystal display devices. As such, the organic light-emitting display device (OLED) is considered to be a next generation display device.

Thin film transistors used in the organic light-emitting display device can be driven in high speed. To this end, the thin film transistors increase carrier mobility using a semiconductor layer which is formed from polysilicon. Polysilicon can be derived from amorphous silicon through a crystallizing process.

A laser scanning mode is widely used in the crystallizing process. During such a crystallizing process, the power of a laser beam may be unstable. As such, the thin film transistors formed along the scanned line, which is scanned by the laser beam, can have different threshold voltages from each other due to different mobilities in each thin film transistor. This can cause image quality to be non-uniform between pixels.

To address this matter, a technology detecting the threshold voltages of pixels and compensating for the threshold voltages of thin film transistors had been proposed. However, in order to realize such threshold voltage compensation, transistors and signal lines connected between the transistors must be added into the pixel. Addition of such transistors and signal lines increases the circuit configuration of the pixel. Moreover, the added transistor and signal lines can reduce an aperture ratio of the pixel, which causes shortening of the life span of the OLED device.

SUMMARY

Embodiments relate to an organic light-emitting display device having a data driver that generates data voltage signal via a data line to operate pixel and also detects a threshold voltage of a driving transistor for controlling current through an organic light emission element. The organic light-emitting display device includes data lines, pixels connected to each of the data lines, and a data driver. The data driver includes a driver unit, a sensing unit and a switching unit. The driver unit generates a first data voltage signal to operate a pixel and a second data voltage signal. The sensing unit detects a threshold voltage of a driving transistor for controlling current through an organic light emission element in the pixel. The switching unit connects the driver unit to the pixel via a data line of the plurality of data lines during first times to transmit the first data voltage signal from the driver unit to the pixel. The switching unit also connects the driver unit to the pixel via the data line during second times to transmit second data voltage signal from the driver unit to the pixel, and connects the sensing unit to the pixel via each of the data line to detect the threshold voltage of the driving transistor during third times.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

In the present disclosure, it will be understood that when an element, such as a substrate, a layer, a region, a film, or an electrode, is referred to as being formed "on" or "under" another element in the embodiments, it may be directly on or under the other element, or intervening elements (indirectly) may be present. The term "on" or "under" of an element will be determined based on the drawings.

Figure 1:
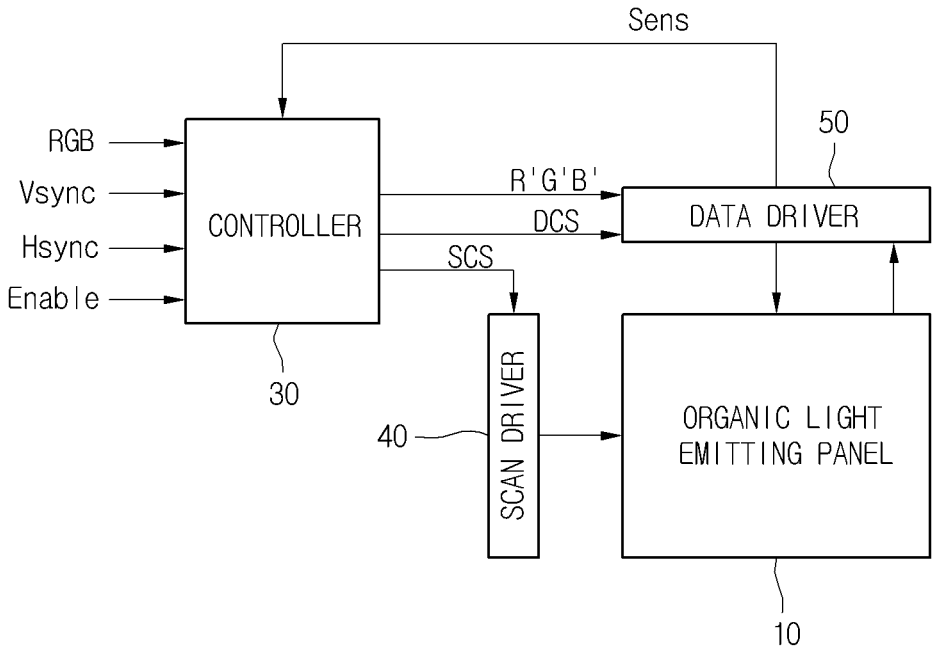
FIG. 1 is a block diagram showing an organic light-emitting display device according to one embodiment.

FIG. 1 is a block diagram showing an organic light-emitting display (OLED) device according to one embodiment. The organic light-emitting display device may include, among other components, an organic light-emitting panel 10, a controller 30, a scan driver 40 and a data driver 50. The scan driver 40 is a circuit that generates and send first and second scan signals SCAN 1 and SCAN 2 to the organic light-emitting panel 10.

The data driver 50 is a circuit that applies data voltages to the organic light-emitting panel 10. Also, the data driver 50 can receive sensing signals Sens from the organic light-emitting panel 10 during a sending period and transmit a sensing signal Sens to the controller 30. The sensing signal Sens can be applied from the data driver 50 to the controller 30.

The controller 30 is hardware, software or a combination thereof that generates scan control signals SCS and data control signals DCS from the enable signal Enable, the vertical synchronous signal Vsync and the horizontal synchronous signal Hsync. The scan control signals SCS are used to control the scan driver 40 and the data control signals DCS are used to control the data driver 50. The controller 30 can modify received data signals RGB based on the sensing signals Sens from the data driver 50 to generate compensated data signals R'G'B' supplied to the data driver 50. The compensated data signals R'G'B' can be converted into compensated analog data voltage signals DATA by the data driver 50. The compensated analog data voltage signals DATA can be applied from the data driver 50 to the organic light emitting panel 10

The compensated analog data voltage signals DATA can operate organic light emission elements on the organic light emitting panel 10. The compensated analog data voltage signals DATA are adjusted to compensate for the threshold voltage of each drive transistor and the properties of each organic light emission element.

Among other advantages, the organic light emitting display device of the present embodiment enables the use of a sensing signal Sens to indicate the threshold voltage of the drive transistor and the properties of the organic light emission element in the organic light emitting panel 10, and also enables the controller 30 to generate a compensated data signal R'G'B' based on the sensing signal Sens. As such, the threshold voltage and the drive transistor and the properties of the organic light emission element can be compensated to prevent non-uniformity of brightness in the organic light emitting panel 10.

Figure 2:
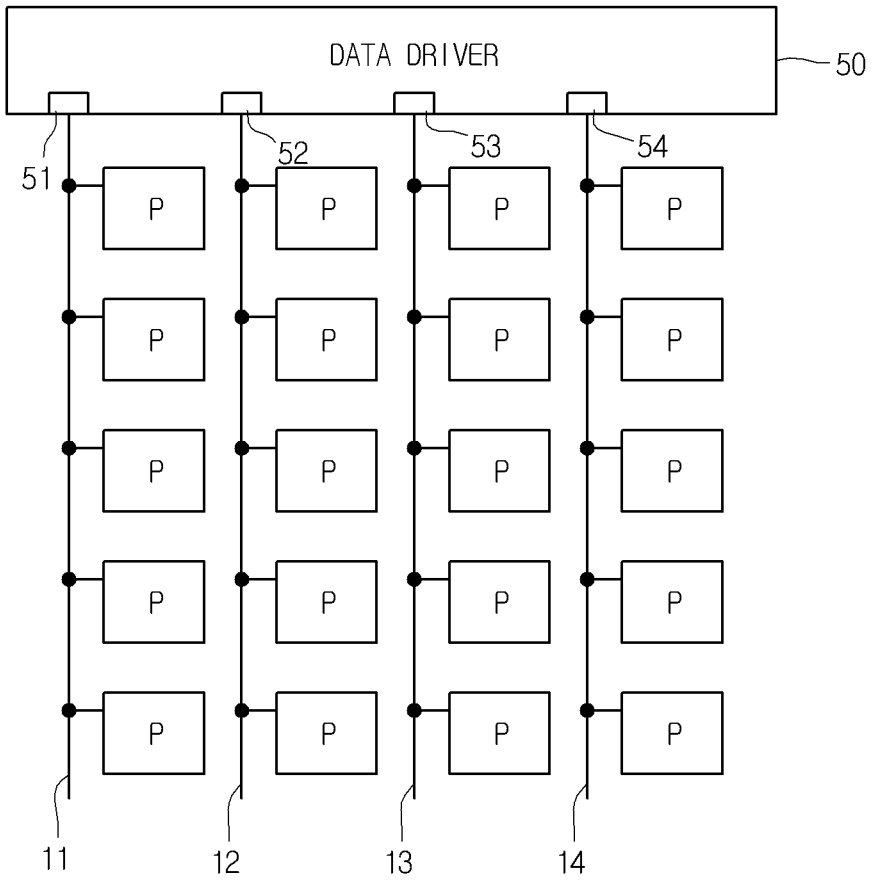
FIG. 2 is a circuit diagram showing an organic light-emitting panel of FIG. 1, according to one embodiment.

FIG. 2 is a circuit diagram showing an organic light-emitting panel of FIG. 1. The organic light-emitting panel 10 may include, among other components, a plurality of data lines 11 through 14 connected to the data driver 50. The data lines 11 through 14 can be connected to channels 51 through 54 of the data driver 10. The channels 51 through 54 can become terminals which are used to apply the data voltages DATA to the organic light-emitting panel 10 or receive the sensing signals from the organic light-emitting panel 10. The data lines 11 through 14 can be disposed along a vertical direction, as an example. Pixels P are disposed between the data lines 11 through 14.

Although not shown in FIG. 2, first and second scan lines are disposed along a horizontal direction perpendicular to the data lines 11 through 14. The first and second scan lines are used to transfer first and second scan signals SCAN 1 and SCAN 2.

Each pixel P can be electrically connected to one of adjacent data lines 11 through 14. For example, pixels P of a first column are connected to a first data line 11 positioned in the left side thereof and another pixels P of a second column can be connected to a second data line 12 positioned in the left side thereof.

The data voltage signals are sent via the data lines 11 through 14 from the data driver 50 to the pixels P. The sensing signals detected from the pixels P are also sent to the data driver 50 via the data lines 11 through 14. In this manner, each data line 11 through 14 can be shared to transmit the data voltage signals and the sensing signals. As a result, the number of channels of the data driver 50 may be reduced. By reducing the number of channels of the data driver 50, the data driver 50 may occupy a smaller space and include fewer components.

Figure 3:
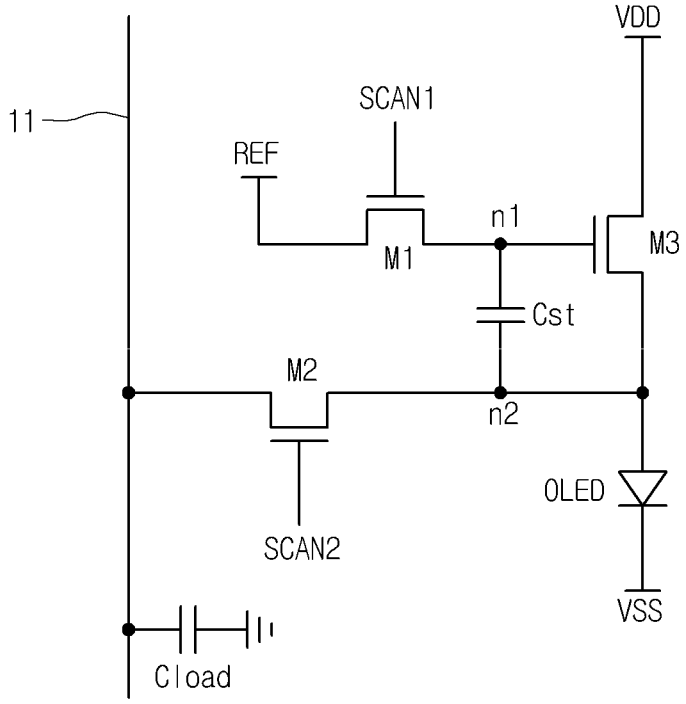
FIG. 3 is a detailed circuit diagram showing a pixel of FIG. 2, according to one embodiment.

FIG. 3 is a detailed circuit diagram showing a pixel P of FIG. 2, according to one embodiment. The pixel P may include, among other components, first transistor M1 through third transistor M3, a storage capacitor Cst, a load capacitor Cload and an organic light emission element OLED. In other embodiments, the pixel P may have a different number of transistors and configuration. The first and second transistors M1 and M2 are used as switching transistors for transferring signals. The third transistor M3 is used as a drive transistor for generating a drive current passed through the organic light emission element OLED to emit light.

The storage capacitor Cst maintains the data voltage DATA for a single frame period. The load capacitor Cload temporarily maintains a voltage on the data line 11.

The organic light emission element OLED is configured to emit light. The organic light emission element OLED can emit light whose brightness or a gray level varies with intensity of the drive current. Such an organic light emission element OLED can include a red organic light emission element OLED that is configured to emit red light, a green organic light emission element OLED that is configured to emit green light, and a blue organic light emission element OLED that is configured to emit blue light.

The first transistor M1 through third transistor M3 can be NMOS-type thin film transistors. The first transistor M1 through third transistor M3 can be turned on by a high voltage level (i.e., active) and turned off by a low voltage level (i.e., inactive) at their gate terminals. The low voltage level may be a ground voltage or a voltage close to the ground voltage. The high voltage level can has a higher value than a threshold voltage of the third transistor M3. A high power supply voltage VDD can be a high voltage level. A second power supply voltage VSS can be a low voltage level.

A reference voltage REF can be set to a low level. The reference voltage REF and the first and second power supply voltages VDD and VSS can be DC (Direct Current) voltages that keep maintaining fixed levels, respectively. The reference voltage REF can be a high level or a voltage close to the high level. For example, the reference voltage REF can be set to be 6V.

The first transistor M1 can be connected to a first node n1. In detail, a gate electrode of the first transistor M1 can be connected to a first scan line, a first terminal of the first transistor M1 can be connected to a reference voltage line, and a second terminal of the first transistor M1 can be connected to the first node n1. When the first transistor M1 is turned on by a first scan signal SCANT, a reference voltage is transferred to the first node n1.

The second transistor M2 is connected to a second node n2. In detail, a gate electrode of the second transistor M2 is connected to a second scan line, a first terminal of the second transistor M2 is connected to a data line 11, and a second terminal of the second transistor M2 is connected to the second node n2. When the second transistor M2 is turned on by a second scan signal SCAN2, the voltage of the data signal on the data line 11 is transferred to the second node n2. The voltage of the data is compensated using a sensing signal that is sent through the data line 11 to the data driver 50 during sensing operation.

A gate electrode of the third transistor M3 is connected to the first node n1, a first terminal of the third transistor M3 is connected to a high power supply line, and a second terminal of the third transistor M3 is connected to the second node n2. The third transistor M3 generates drive current based on the voltage difference value between its gate electrode (i.e., the first node n1) and its second terminal (i.e., the second node n2). The drive current generated in the third transistor M3 passes through the organic light emission element OLED.

The storage capacitor Cst is electrically connected between the first and second nodes n1 and n2. In detail, a first terminal of the storage capacitor Cst is connected to the first node n1, and the second terminal of the storage capacitor Cst is connected to the second node n2. The storage capacitor Cst maintains the voltage different between the first node n1 and the second node n2. For example, the voltage of the first node n1 is the reference voltage REF and the voltage of the second node n2 is the data voltage.

The organic light emission element OLED is electrically connected to the second node n2. In detail, a first terminal of the organic light emission element OLED is connected to the second node n2, and a second terminal of the organic light emission element OLED is connected to a low power supply line. The organic light emission element OLED can receive the drive current Ioled generated in the third transistor M3 and emit light whose brightness or a gray level corresponds to the drive current Ioled (refer to FIG. 5C).

The pixels P operate in two different modes: an emission mode and a sensing mode. In an emission mode, the pixels P emit light by generating and passing driving current through the organic light emission element OLED. The sensing mode is performed, for example, (i) prior to the shipment of product incorporating the pixel P, (ii) after the power on or power off or (iii) during a vertical blank period positioned between frame periods. Although not shown in the drawings, the sensing mode can be performed for a first row of pixels P in a first vertical blank period after a first frame period, a second row of pixels P in a second vertical blank period after a second frame period, and a third row of pixels P in a third vertical blank period after a third frame period. In this manner, the sensing mode can be performed for the remaining rows of pixels P.

Figure 4:
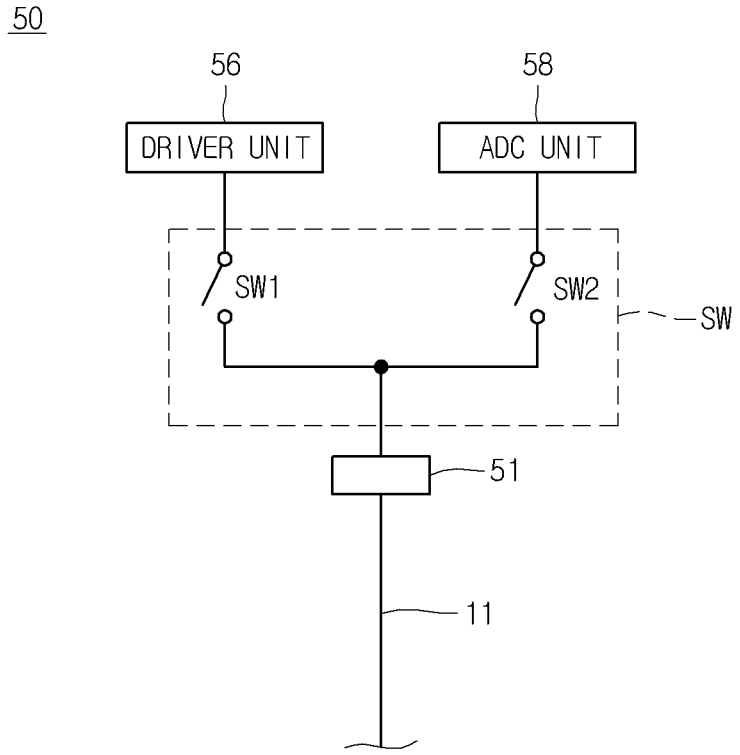
FIG. 4 is a circuit diagram showing a part of the data driver of FIG. 1, according to one embodiment.

FIG. 4 is a circuit diagram showing a part of the data driver 50 of FIG. 1, according to one embodiment. The data driver 50 may include, among other components, a switch unit SW, a driver unit and an analog-to-digital converter (ADC) for each channel. The switch unit SW may include a first switch element SW1, a second switch element SW2. In FIG. 4, the first element SW1, a second switch element SW2, a driver unit and an ADC unit for the first channel 51 are illustrate. The data driver 50 may include the same or similar components for other channels 52 through 54.

The driver unit 56 generates a data voltage for the emission mode or another data voltage for the sensing mode. The data voltage for the emission mode can be referred to as a first data voltage and the data voltage for the sensing mode can be referred to as a second data voltage. The data voltage for the emission mode can be prepared by converting a data signal applied from the controller 30 into an analog data voltage under the control of the data control signals DCS from the controller 30. The data voltage for the sensing mode can be a previously set analog data voltage or another analog data voltage generated in the driver unit 56.

The data voltage for the emission mode is used to display a gray level through the organic light emission element OLED. As such, the data voltages for the emission mode can have different values from one another according to the pixels P. In other words, the data voltage for the emission mode can often vary. On the other hand, the data voltage for the sensing mode can be a data voltage which is used to drive each pixel P in order to generate a sensing signal for each pixel P.

The organic light emission element OLED within each pixel P is not to emit light when the data voltage for the sensing mode is transmitted via the data line 11. For this purpose, the data voltage for the sensing mode can be set lower than the threshold voltage of the organic light emission element OLED but higher than the threshold voltage of the third transistor M3 used as a drive transistor.

The ADC unit 58 has a function of converting an analog sensing signal, which is detected in each pixel P, into a digital sensing signal. The digital sensing signal converted by the ADC unit 58 can be applied to the controller 30 and is taken into account to generate the data signal.

A first switch element SW1 for controlling the data voltages for the emission mode and the sensing mode to be applied to the channel 51 can be disposed between the driver unit 56 and the channel 51. Also, a second switch element SW2 for controlling the sensing signal to be transferred to the ADC unit 58 can be disposed between the ADC unit 58 and the channel 51.

For example, when the first switch element SW1 is turned on, the data voltage for the emission mode or the data voltage for the sensing mode can be transferred from the driver unit 56 to the pixels P connected to the data line 11 via the first switch element SW1 and the data line 11. As such, one of the pixels P connected to the data line 11 can be driven by either the data voltage for the emission mode or the data voltage for the sensing mode. In detail, the organic light emission element OLED can emit light by the data voltage for the emission mode. Also, the sensing signal can be detected by the data voltage for the sensing mode.

As an example, when the second switch element SW2 is turned on, the sensing signal detected in a pixel P can be applied to the ADC unit 58 via the data line 11 connected to the pixel P and the second switch element SW2. The sensing signal can be converted into the digital sensing signal by the ADC unit 58. The digital sensing signal can be applied from the ADC unit 58 to the controller 30

The first and second switch elements SW1 and SW2 can be turned on or off in an opposite manner. For example, when the first switch element SW1 is turned on, the second switch element SW2 is turned off. On the contrary, if the second switch element SW2 is turned on, the first switch element SW1 is turned off.

The first and second switch elements SW1 and SW2 can be switched by different switch control signals or the same control signal. For example, the first and second switch elements SW1 and SW2 can be CMOS-type transistors. In this case, the first and second switch elements SW1 and SW2 can be switch by a single switch control signal.

Figure 5A:
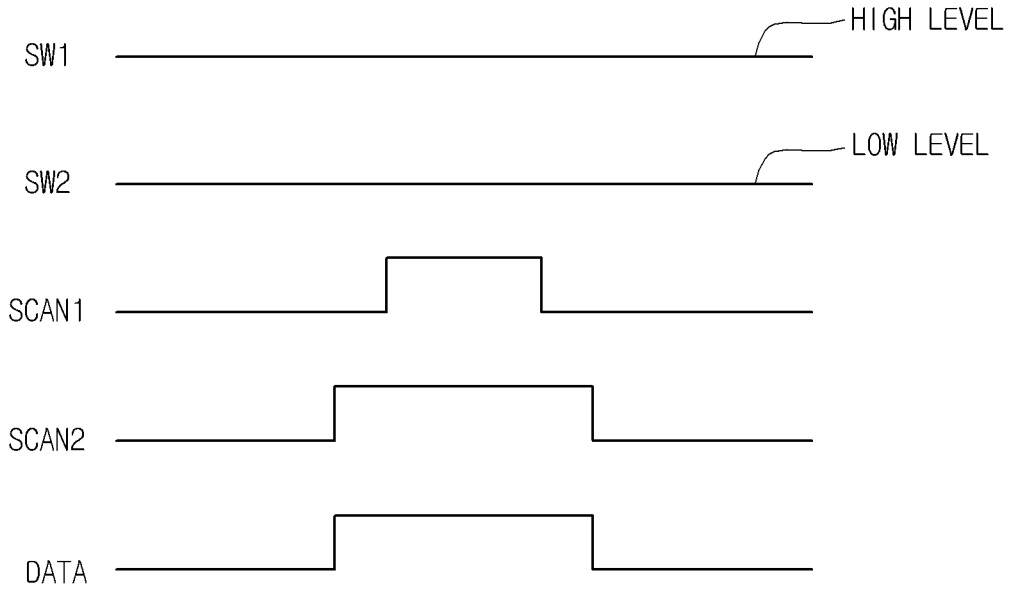
FIG. 5A is a waveform diagram illustrating scan signals which is applied to a pixel at a light emitting operation, according to one embodiment.

FIG. 5A is a waveform diagram illustrating scan signals applied to a pixel P at a light emitting operation, according to one embodiment. As shown in FIG. 5A, in the emission mode, a first switch control signal applied to the first switch element SW1 can be at a high voltage level (i.e., active), but a second switch control signal applied to the second switch element SW2 can be at a low voltage level (i.e., inactive). As a result, the first switch element SW1 is turned on but the second switch element SW2 is turned-off.

Accordingly, the data voltage for the emission mode can be applied from the driver unit 56 to the data line 11 via the first switch element SW1. Also, the data voltage for the emission mode can be stored in the load capacitor Cload.

The first and second scan signals SCAN1 and SCAN2 can be at a high voltage level during a first period of the emission mode. The first and second scan signals SCAN1 and SCAN2 can have either the same width (i.e., active period when the signal is at a high voltage level) or different widths. For example, the second scan signal SCAN2 can have a width wider than that of the first scan signal SCAN1. In detail, the second scan signal can rise before the first scan signal SCAN1, and drop after the second scan signal SCAN2 drops to an inactive state.

Figure 5B:
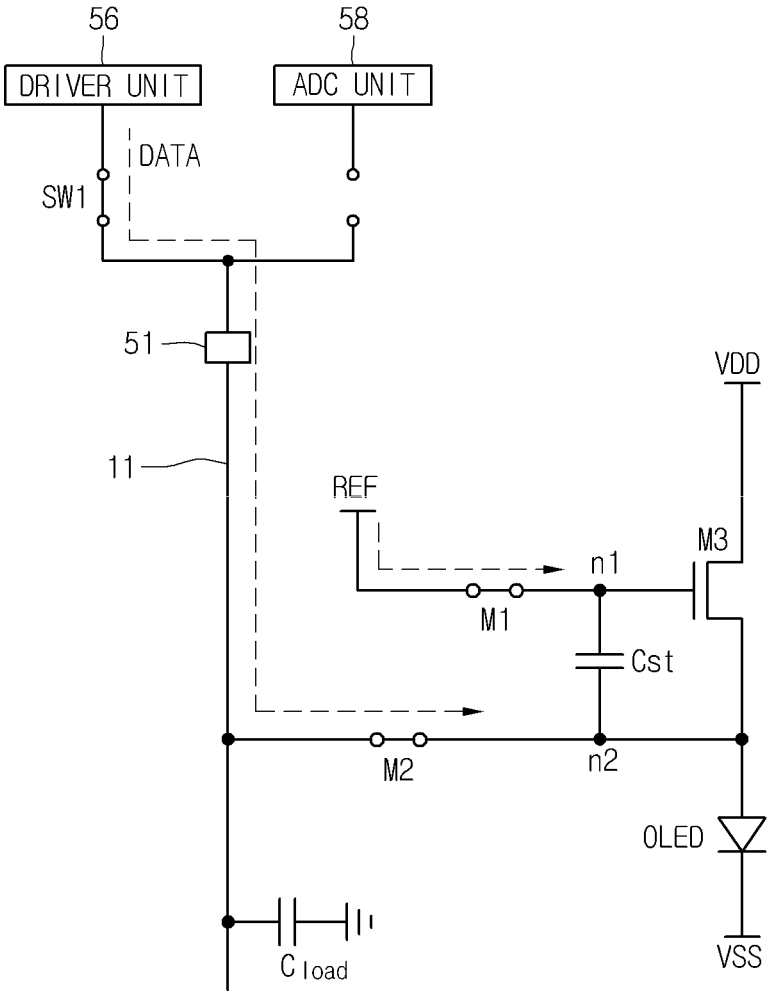
FIG. 5B is a circuit diagrams showing switching states of transistors in a first period for a light emitting operation, according to one embodiment.

FIG. 5B is a circuit diagrams showing switched states of transistors in a first period during a light emitting operation, according to one embodiment. As shown in FIG. 5B, because the first transistor M1 is turned on by the first scan signal SCAN1 at a high voltage level, the reference voltage REF is applied to the first node n1 via the first transistor M1. As a result, the first node n1 is pulled up to the reference voltage REF.

If the first node n1 is not pulled up to the reference voltage REF (i.e., the reference voltage REF is not applied to the first node n1), the voltage at the first node n1 can vary with the variation of the first power supply voltage VDD or the property variation of the organic light emission element OLED. In this case, when the data voltage for the emission mode is applied to the second node n2, the drive current of the third transistor M3 varies due to the voltage variation at the second node n2 causing the picture quality to deteriorate.

The second transistor M2 is turned on by the second scan signal SCAN2 with a rising edge that follows the rising edge of the first scan signal SCAN1. As such, the data voltage of the emission mode applied to the data line 11 can be transferred to the second node n2 via the second transistor M2.

While the first and second scan signals SCAN1 and SCAN2 maintain a high voltage level (i.e., during the first period of the emission mode), not only the reference voltage REF is applied to the first node n1 but also the data voltage is applied to the second node n2.

Figure 5C:
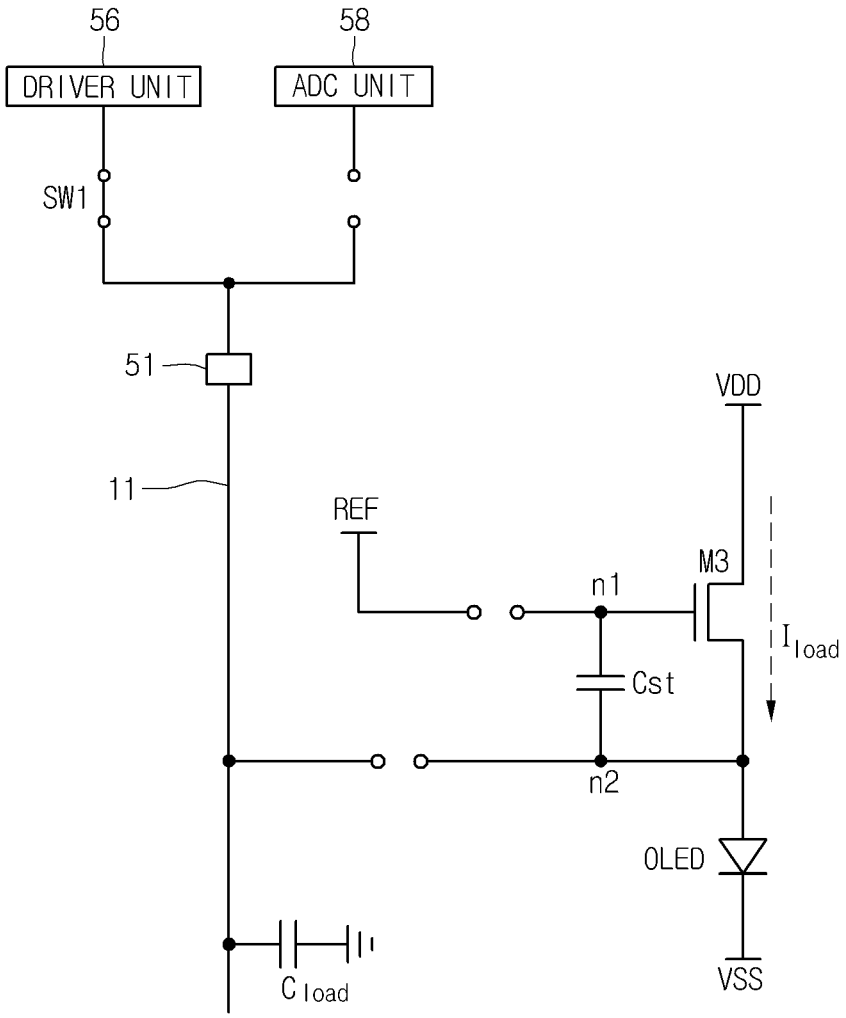
FIG. 5C is a circuit diagrams showing switching states of transistors in a second period at a light emitting operation, according to one embodiment.

FIG. 5C is a circuit diagram showing switched states of transistors in a second period at a light emitting operation. As shown in FIG. 5C, while the first and second scan signals SCAN1 and SCAN2 turn inactive after remaining in an active state for a period (i.e., during a second period of the emission mode), the third transistor M3 generates drive current Ioled in accordance with the different value between the reference voltage REF of the first node n1 and the data voltage of the second node n2. The drive current Ioled flows through the organic light emission element OLED to cause the organic light emission element OLED to emit light.

Figure 6A:
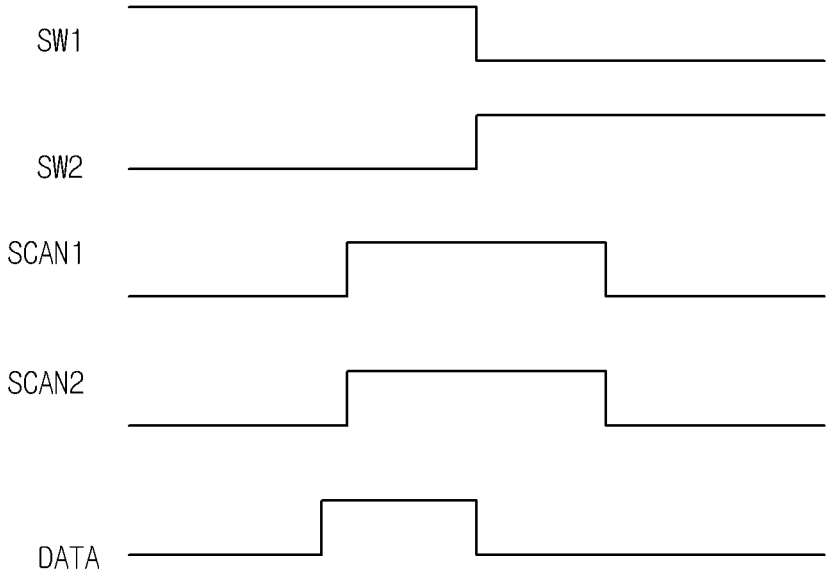
FIG. 6A is a waveform diagram illustrating scan signals which is applied to a pixel for a sensing operation, according to one embodiment.

FIG. 6A is a waveform diagram illustrating scan signals which is applied to a pixel during a sensing operation, according to one embodiment. As shown in FIG. 6A, the sensing mode can be performed during first and second periods. In the first period of the sensing mode, a first switch control signal applied to the first switch element SW1 is at a high voltage level, but a second switch control signal applied to the second switch element SW2 is at a low voltage level. During the second period of the sensing mode, a first switch control signal applied to the first switch element SW1 is at a low voltage level, but a second switch control signal applied to the second switch element SW2 is at a high voltage level. As a result, the first switch element SW1 is turned on to transfer the data voltage for the sensing mode from the driver unit 56 to the data line 11 through the first switch element SW1 in the first period of the sensing mode. Also, the data voltage for the sensing mode is stored into the load capacitor Cload.

During the second period of the sensing mode, the second switch element SW2 is turned on and a sensing signal detected in the pixel P is transferred to the ADC unit 58. As described above, the data voltage for the sensing mode can be set to be lower than the threshold voltage of the organic light emission element OLED but higher than the threshold voltage of the third transistor M3 used as a drive transistor.

The first and second scan signals SCAN1 and SCAN2 can be at the high voltage level during both the first and second periods of the emission mode. The first and second scan signals SCAN1 an SCAN2 can have either the same width or different widths of activation. The second scan signal SCAN2 can have a width of activation wider than that of the first scan signal SCAN1.

Figure 6B:
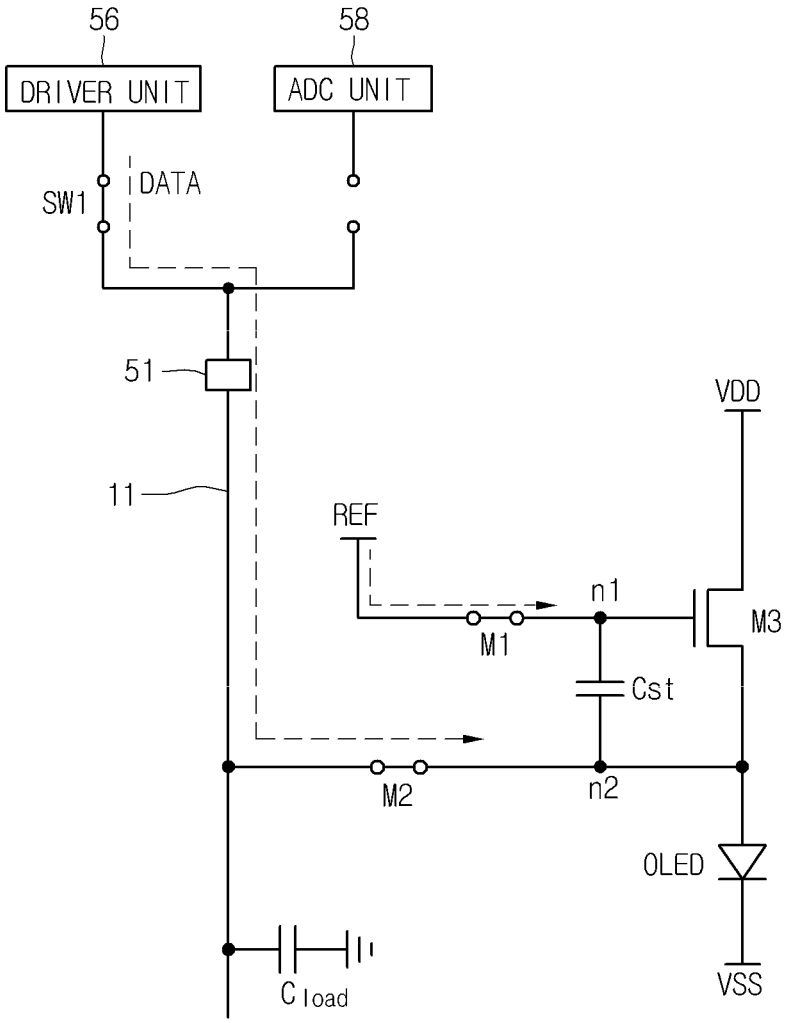
FIG. 6B is a circuit diagram showing switching states of transistors in a first period for a sensing operation, according to one embodiment.

FIG. 6B is a circuit diagram showing the switched states of transistors in a first period at a sensing operation, according to one embodiment. As shown in FIG. 6B, the first switch element SW1 can be turned on in the first period of the sensing mode. As such, the data voltage for the sensing mode can be transferred from the driver unit 56 to the data line 11 through the first switch element SW1 in the first period of the sensing mode.

The first transistor M1 is turned on by the first scan signal SCAN1 at a high voltage level. As a result, the reference voltage REF can be applied to the first node n1 via the first transistor M1. Accordingly, the first node n1 can be charged with the reference voltage REF. The second transistor M2 is also turned on by the second scan signal SCAN2 at a high voltage level. As a result, the data voltage of the sensing mode applied to the data line 11 can be transferred to the second node n2 via the second transistor M2. In other words, during the first interval of the sensing mode, not only the reference voltage REF is applied to the first node n1 but also the data voltage is applied to the second node n2.

Figure 6C:
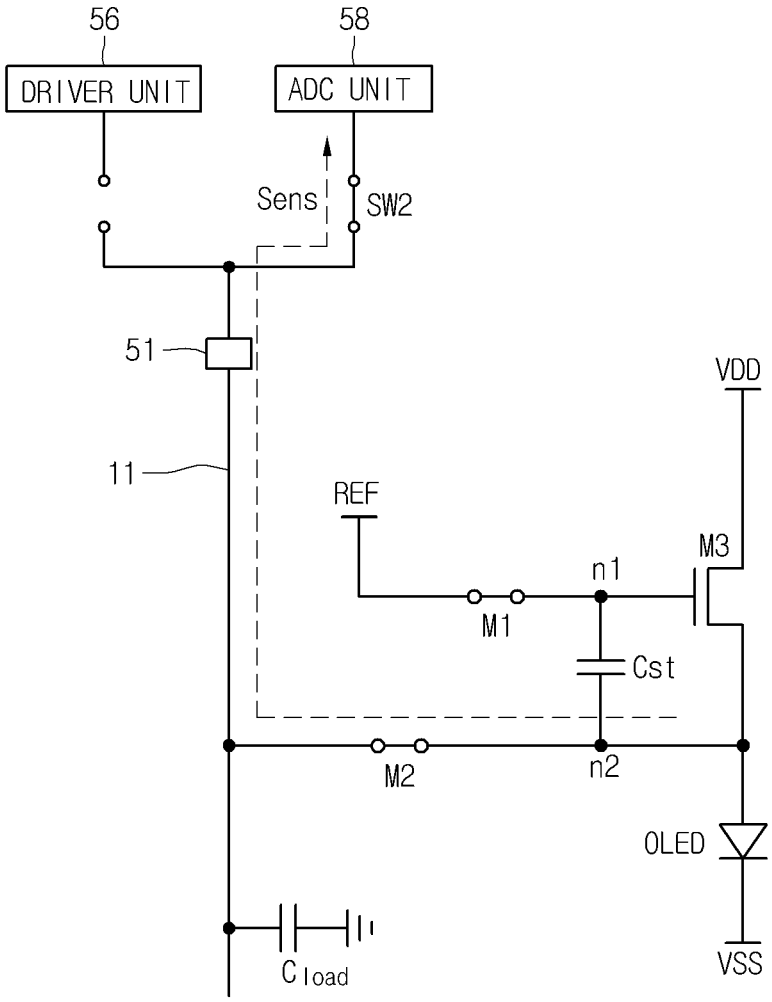
FIG. 6C is a circuit diagram showing switching states of transistors in a second period for a sensing operation, according to one embodiment.

FIG. 6C is a circuit diagram showing switching states of transistors in a second period at a sensing operation, according to one embodiment. As shown in FIG. 6C, the second switch element SW2 is turned on instead of the first switch element SW1 in the second period of the sensing mode. Also, the first and second transistors M1 and M2 is turned on by the first and second scan signals SCAN1 and SCAN2 each at a high voltage level.

In the first period of the sensing mode, not only the reference voltage REF is applied to the first node n1 but also the data voltage is applied to the second node n2. However, because the first switch element SW1 is turned off and the second switch element SW2 is turned on, the data voltage for the sensing mode is no longer applied to the second node n2 in the second period of the sensing mode. During the second period of the sensing mode, sensing current Sens flows from the second node n2 to ADC unit 58 due to stored charge in the storage capacitor Cst which corresponds to the voltage different between the reference voltage REF at the first node n1 and the data voltage for the sensing mode at the second node n2. The sensing current Sens flows from the third transistor M3 until the voltage at the second node n2 is decreased to the threshold voltage of the third transistor M3. Accordingly, the voltage of the second node n2 (i.e., the threshold voltage of the third transistor M3) is charged into the load capacitor Cload. The threshold voltage of the third transistor M3 charged into the load capacitor Cload is detected by the ADC unit 58 via the data line 11 and the second switch element SW2.

The sensing signal Sens can be converted into a digital sensing signal by the ADC unit 58. The digital sensing signal Sens can be applied to the controller 30. The controller 30 supplies the data driver 50 with a compensated data signal which is compensated using the sensing signal. The data driver 50 converts the compensated data signal into a compensated data voltage and applies the compensated data voltage to the respective pixel P. Accordingly, light corresponding to drive current compensated to take account the threshold voltage of the third transistor M3 is generated by the light emitting element OLED.

Figure 7:
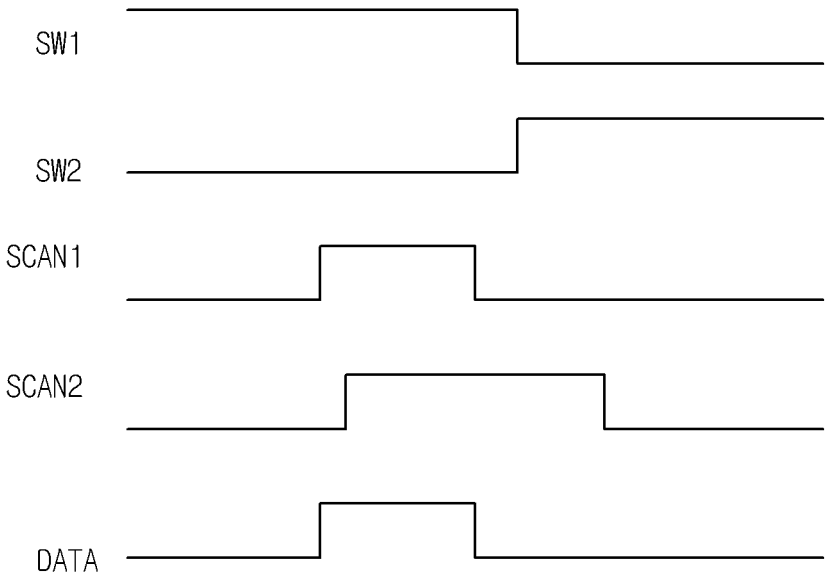
FIG. 7 is a waveform diagram illustrating scan signals which is applied to a pixel at a sensing operation, according to another embodiment.

In another embodiment, a first scan signal SCAN1 having a different waveform compared to the first scan signal SCAN1 of FIG. 6A is used, as shown in FIG. 7. In other words, the first scan signal SCAN1 is at a high voltage level only during the first period of the sensing mode. As a result, the first scan signal SCAN1 remains at a low voltage level in the second period of the sensing mode. Also, after the first scan signal SCAN1 stays at the low voltage level, the switch control signals applied to the first switch element SW1 is turned off and the second switch element SW2 is turned on. For example, the falling edge of the first switch control signal for the first switch element SW1 and the rising edge of the second switch control signal for the second switch element SW2 can be set to follow the rising edge of the first scan signal SCAN1. As an example, the rising edge of the second switch control signal for the second switch element SW2 can be positioned between the falling edges of the first and second scan signals SCAN1 and SCAN2.

As described above, in the first period of the sensing mode, the first switch element SW1 and the first and second transistors M1 and M2 are turned on, but the second switch element SW2 is turned off. As a result, the reference voltage REF is applied to the first node n1 and the data voltage for the sensing mode is applied to the second node n2.

In the second period of the sensing mode, the second transistor M2 is turned on, but the first transistor M1 is turned off. At this time, not only the reference voltage REF is no longer applied to the first node n1 but also the data voltage for the sensing mode is no longer applied to the second node n2. As a result, a stored voltage of the storage capacitor Cst, that is, the voltage different between the reference voltage REF and the data voltage for the sensing mode can be maintained.

Thereafter, the first switch element SW1 is turned off but the second switch element SW2 is turned on. As a result, sensing current Sens flows out from the third transistor M3 by a stored voltage of the storage capacitor Cst which corresponds to the different value between the reference voltage REF at the first node n1 and the data voltage for the sensing mode at the second node n2. The sensing current Sens flows out from the third transistor M3 until the voltage at the second node n2 is pulled down to the threshold voltage of the third transistor M3. Accordingly, the ADC unit 58 can detect the voltage of the second node n2 via the data line 11 and the second switch element SW2 and determine the threshold voltage of the third transistor M3.

In the above embodiments, the high power supply voltage VDD was described as being supplied continuously to the third transistor M3. However, it is preferable not to apply the first power supply voltage VDD to the third transistor M3 while the first and second scan signals SCAN1 and SCAN2 are maintained at a high voltage level. For this reason, a fourth transistor configured to control the supply of the first power supply voltage VDD can be additionally disposed on the high power supply line if necessary. The fourth transistor can be a NMOS type thin film transistor which can be turned on by a scan signal with a high level. For example, the third scan signal is not at the low voltage level only while the first and second scan signals SCAN1 and SCAN2 maintain the high level, but also when the first and second scan signals SCAN1 and SCAN2 are at a low voltage level.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light-emitting display device, comprising:

a plurality of data lines;

a plurality of pixels connected to each of the plurality of data lines, each pixel comprising:

a first transistor configured to switch connection between a first node and a reference voltage source;

a second transistor configured to switch connection between a second node and one of the plurality of data lines;

an organic light emission element coupled between the second node and a first supply voltage source;

a driving transistor having a first terminal coupled to a power supply line, a gate terminal directly connected to the first node, and a second terminal directly connected to the second node; and a storage capacitor connected between the first and second nodes; and a data driver comprising:

a driver unit configured to generate a first data voltage signal and a second data voltage signal;

a sensing unit configured to detect a threshold voltage of the driving transistor of each pixel;

a switching unit configured to:

connect the driver unit to each of the pixels via the one of the plurality of data lines during first times to transmit the first data voltage signal from the driver unit to each pixel, the storage capacitor storing a voltage difference between a reference voltage of the reference voltage source and a voltage at the one of the plurality of data lines during the first times, connect the driver unit to each pixel via the data line during second times to transmit second data voltage signal from the driver unit to each pixel, and connect the sensing unit to each pixel via each of the data line to detect the threshold voltage of the driving transistor during third times.

2. The organic light-emitting display device of claim 1, wherein the second data voltage signal is configured to set a voltage difference between the first node and the second node.

3. The organic light-emitting display device of claim 1, wherein the switching unit comprises:

a first switch configured to turn on during the first times to transmit the first data voltage signal to the pixel and turn on during the second times to transmit the second data voltage signal to the pixel, the first switch configured to turn off during the third times, and a second switch configured to turned on to connect the sensing unit to the pixel during the third times, the second switch configured to turned off during the first times and the second times.

4. The organic light-emitting display device of claim 1, wherein the first transistor in the pixel is turned on to connect the reference voltage source to the first node.

5. The organic light-emitting display device of claim 1, wherein the driving transistor provides current through the organic light emission element based on the first data voltage.

6. The organic light-emitting display device of claim 1, wherein the first transistor is operated by a first scan signal and the second transistor is operated by a second scan signal, wherein the first scan signal rises to an active state before the second scan signal.

7. The organic light-emitting display device of claim 6, wherein the first scan signal drops to an inactive state before the second scan signal.

8. The organic light-emitting display device of claim 1, wherein during the second times, the first transistor is turned on to connect the reference voltage source to the first node, the second transistor is turned on to couple the second node to the driver unit to receive the second data voltage signal, and the first switch is turned on to connect the driver unit to the second node.

9. The organic light-emitting display device of claim 8, wherein during the third times, the first switch is turned off and the second switch is turned on to connect the pixel to the sensing unit.

10. The organic light-emitting display device of claim 1, wherein a voltage level of the second data voltage signal is higher than a threshold voltage of the driving transistor but lower than a threshold voltage of the organic light emission element.

11. The organic light-emitting display device of claim 1, wherein the third times comprise vertical blank periods.

12. The organic light-emitting display device of claim 1, further comprising a controller configured to generate a compensated data signal based on the detected threshold voltage of the driving transistor, the data driver generating another first data voltage signal for a subsequent frame based on the compensated data signal.

13. A method of operating an organic light-emitting display device, comprising:

generating a first data voltage signal at first times by a driver unit;

connecting the driver unit to the pixel via a data line during the first times to transmit the first data voltage signal from the driver unit to a pixel;

storing a voltage difference between a first node directly connected to a gate terminal of a driving transistor and a second node directly connected to a terminal of the driving transistor based on the first data voltage signal in a capacitor;

controlling driving current in an organic light emission element of the pixel by the driving transistor based on the voltage difference at the first times;

generating a second data voltage signal at second times by the driver unit;

connecting the driver unit to the pixel via the data line during the second times to transmit the second data voltage signal from the driver unit to the pixel;

turning on a first transistor in the pixel during the second times to connect a reference voltage source to the gate terminal of the driving transistor;

turning on a second transistor in the pixel to connect a second node to the data line during the second times;

connecting a sensing unit of the data driver to the pixel via each of the data line during third times subsequent to the second times to transmit sensing signal from the pixel to the sensing unit;

detecting a threshold voltage of the driving transistor by the sensing unit based on the sensing signal at the third times; and receiving a compensated data signal by the driver unit to generate another first data voltage signal, the compensated data signal generated based on the detected threshold voltage of the driving transistor.

14. The method of claim 13, further comprising:

turning on a first switch during the first times to transmit the first data voltage signal to the pixel;

turning on the first switch during the second times to transmit the second data voltage signal to the pixel;

turning off the first switch during the third times;

turning on a second switch to connect the sensing unit to the pixel during the third times; and turning off the second switch during the first times and the second times.

15. The method of claim 13, wherein the third times comprise vertical blank periods.

16. The method of claim 13, further comprising:

operating the organic light-emitting element to emit light by passing the driving current through the organic light-emitting element.

17. The method of claim 13, wherein a voltage level of the second data voltage signal is higher than a threshold voltage of the driving transistor but lower than a threshold voltage of the organic light emission element.

18. An apparatus comprising:

an organic light-emitting panel including a plurality of pixels connected a plurality of data lines for supplying a sensing data voltage to the pixels during a sensing interval, each pixel comprising:

a first transistor configured to switch connection between a first node and a reference voltage source;

a second transistor configured to switch connection between a second node and one of the plurality of data lines;

an organic light emission element coupled between the second node and a first supply voltage source;

a driving transistor having a first terminal coupled to a power supply line, a gate terminal directly connected to the first node, and a second terminal directly connected to the second node;

a storage capacitor connected between the first and second nodes; and a load capacitor connected to one of the plurality of data lines and configured to charge a threshold voltage of the drive transistor; and a driving unit configured to supply a data voltage to the pixels during a display interval and supply the sensing data voltage to the pixels during the sensing interval, the driving unit further configured to sense the threshold voltage of the drive transistor during the sensing interval.

19. The apparatus of claim 18, wherein the sensing data voltage during the sensing interval has a voltage lower than the threshold voltage of the organic light emission element.

* * * * *